US008430399B1

(12) United States Patent
Huang et al.

(10) Patent No.: US 8,430,399 B1
(45) Date of Patent: Apr. 30, 2013

(54) PAPER TRAY

(75) Inventors: Wen-An Huang, Taipei (TW); Chao-Min Yang, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 0 days.

(21) Appl. No.: 13/599,829

(22) Filed: Aug. 30, 2012

(30) Foreign Application Priority Data

May 11, 2012 (TW) ..... 101116927 A

(51) Int. Cl.
*B65H 1/00* (2006.01)

(52) U.S. Cl.
USPC ..... 271/171; 271/223

(58) Field of Classification Search ..... 271/171, 271/207, 213, 220, 223
See application file for complete search history.

(56) References Cited

U.S. PATENT DOCUMENTS 5,975,520 A * 11/1999 Shim ..... 271/171
8,272,637 B2 * 9/2012 Asada et al. ..... 271/171
2004/0036208 A1 * 2/2004 Yanagi et al. ..... 271/171
2004/0051234 A1 * 3/2004 Lien et al. ..... 271/171
2006/0082044 A1 * 4/2006 Aida ..... 271/145
2008/0111875 A1 * 5/2008 Nagashima et al. ..... 347/104
2009/0224463 A1 * 9/2009 Chinzei et al. ..... 271/207
2011/0278789 A1 * 11/2011 Otani et al. ..... 271/207
2011/0285077 A1 * 11/2011 Otani et al. ..... 271/213

* cited by examiner

*Primary Examiner* — David H Bollinger
(74) *Attorney, Agent, or Firm* — Kirton McConkie; Evan R. Witt

(57) ABSTRACT

A paper tray includes a first plate and an extension mechanism. The first plate includes a receiving space and a guiding groove. The extension mechanism includes a second plate, a paper stopper, and an elastic element. When the extension mechanism is moved to a first position in a direction opposite to the first plate and the paper stopper is rotated relative to the second plate in a first direction, the elastic element is pushed by an end of the paper stopper. Consequently, the elastic element generates an elastic potential energy. When the paper stopper is rotated relative to the second plate in a second direction, the elastic potential energy drives movement of the elastic element in a direction facing the first plate, so that the second plate is moved to a second position and the extension mechanism is automatically restored to the receiving space.

6 Claims, 6 Drawing Sheets

PAPER TRAY

FIELD OF THE INVENTION

The present invention relates to a paper tray, and more particularly to a paper tray with an extension mechanism.

BACKGROUND OF THE INVENTION

For achieving both functions of receiving papers and supporting different-sized papers, the current office machine such as a copying device, a printing device or a scanning device is usually equipped with a paper tray having an extension mechanism.

FIG. 1 schematically illustrates the outward appearance of a conventional office machine. As shown in FIG. 1, the conventional office machine 100 comprises a paper tray 130 for supporting papers. The paper tray 130 comprises a first portion 131, a second portion 132, and a third portion 138. The second portion 132 is disposed under the first portion 131, and movable relative to the first portion 131. The third portion 138 is pivotally coupled to a distal end of the second portion 132, and rotatable relative to the second portion 132.

Please refer to FIG. 1 again. The first portion 131 of the paper tray 130 comprises a guiding structure 133 and two protrusion structures 136 and 137. The second portion 132 of the paper tray 130 comprises two grooves 134 and 135. Moreover, the third portion 138 of the paper tray 130 comprises a stopping edge structure 139.

The guiding structure 133 and the protrusion structures 136 and 137 are disposed on a bottom surface of the first portion 131 and contacted with both sides of the second portion 132 for supporting and guiding the second portion 132. The grooves 134 and 135 are formed in a top surface of the second portion 132. The protrusion structures 136 and 137 are respectively aligned with the grooves 134 and 135 in order to guide the second portion 132.

For supporting large-sized papers, the paper tray 130 should be expanded. For expanding the paper tray 130, the second portion 132 is moved relative to the first portion along the guiding structure 133 and the protrusion structures 136 and 137. Meanwhile, since the supporting range of the paper tray 130 is increased, the paper tray 130 can support different-sized papers.

Moreover, the paper tray 130 may be further expanded in order to further increase the supporting range of the paper tray 130 and achieve a stopping function of the paper tray 130. As shown in FIG. 1, after the third portion 138 pivotally coupled to and stacked on the second portion 132 is rotated relative to the second portion 132 by 180 degrees, the supporting range of the paper tray 130 is further expanded. Moreover, since the stopping edge structure 139 of the third portion 138 is oriented in the direction perpendicular to the papers, the possibility of falling down the papers from the paper tray 130 will be largely reduced.

Although the paper tray 130 of the conventional office machine 100 has the functions of receiving papers and supporting different-sized papers, there are still some drawbacks. For storing the paper tray 130, the third portion 138 is firstly rotated to be staked on the second portion 132, and then the second portion 132 is moved to the region under the first portion 131 along the guiding structure 133 and the protrusion structures 136 and 137.

In other words, the process of manually storing the paper tray 130 is not user-friendly. Moreover, if the user forgets to rotate the third portion 138 but directly move the second portion 132 to the region under the first portion 131, the third portion 138 fails to be successfully stored.

Meanwhile, although the second portion 132 has been stored, the second portion 132 should be expanded again in order to store the third portion 138. Under this circumstance, the process of manually storing the paper tray 130 wastes additional time.

SUMMARY OF THE INVENTION

The present invention provides a paper tray with an automatic position-restoring function.

In accordance with an aspect of the present invention, there is provided a paper tray for supporting a paper. The paper tray includes a first plate and an extension mechanism. The first plate includes a receiving space and a guiding groove. The guiding groove is located within the receiving space. The extension mechanism is accommodated within the receiving space. Moreover, the extension mechanism includes a second plate, a paper stopper, and an elastic element. The second plate includes a sliding groove. The sliding groove is formed in a bottom surface of the second plate. The paper stopper is pivotally coupled to the second plate and rotatable relative to the second plate. The elastic element is disposed in the guiding groove of the first plate, and includes a helical part, a first elastic arm, and a second elastic arm. The helical part is contacted with a surface of the guiding groove and movable relative to the guiding groove. The first elastic arm is connected with the paper stopper. The second elastic arm is accommodated within the sliding groove of the second plate. When the second plate is moved to a first position in a direction opposite to the first plate and the paper stopper is rotated in a first direction, the elastic element is pushed by an end of the paper stopper, so that the elastic element generates an elastic potential energy. When the paper stopper is rotated in a second direction, the elastic potential energy drives movement of the elastic element in a direction facing the first plate, so that the second plate is moved to a second position and accommodated within the receiving space.

In an embodiment, the paper stopper includes a stopping part for stopping the paper and a sustaining part for sustaining against the elastic element. The stopping part is connected with the sustaining part. Moreover, an included angle is formed between the stopping part and the sustaining part, wherein the included angle is smaller than or equal to 90 degrees.

In an embodiment, the paper stopper further includes a concave structure for facilitating moving the extension mechanism.

In an embodiment, the guiding groove has a slant, and the slant is located at a front end of the guiding groove. When the second plate is moved to the first position and the paper stopper is rotated in the first direction, the helical part of the elastic element is contacted with the slant.

In an embodiment, the receiving space has an opening and an inner wall. The opening is opposed to the inner wall. Moreover, the opening is located at an altitude higher than the inner wall.

In an embodiment, the elastic element is a torsion spring.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a paper tray. The paper tray is located at a paper inlet and/or a paper outlet of an office machine (e.g. a fax device, a copying device, a printing device, a scanning device, an automatic document feeder or any other common office machine). The paper tray is used for supporting the papers to be fed into the office machine or supporting the papers outputted from the office machine.

Figure 1:
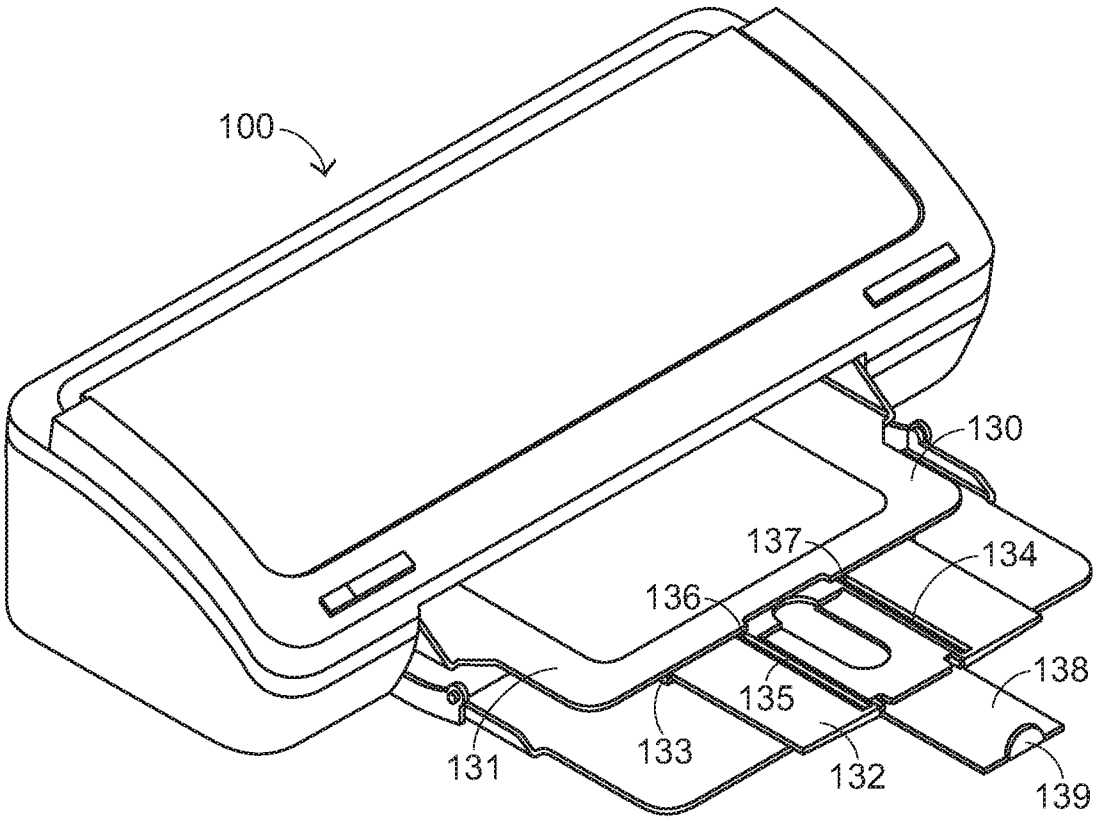
FIG.1 PRIOR ART
FIG. 1 schematically illustrates the outward appearance of a conventional office machine.
Figure 2:
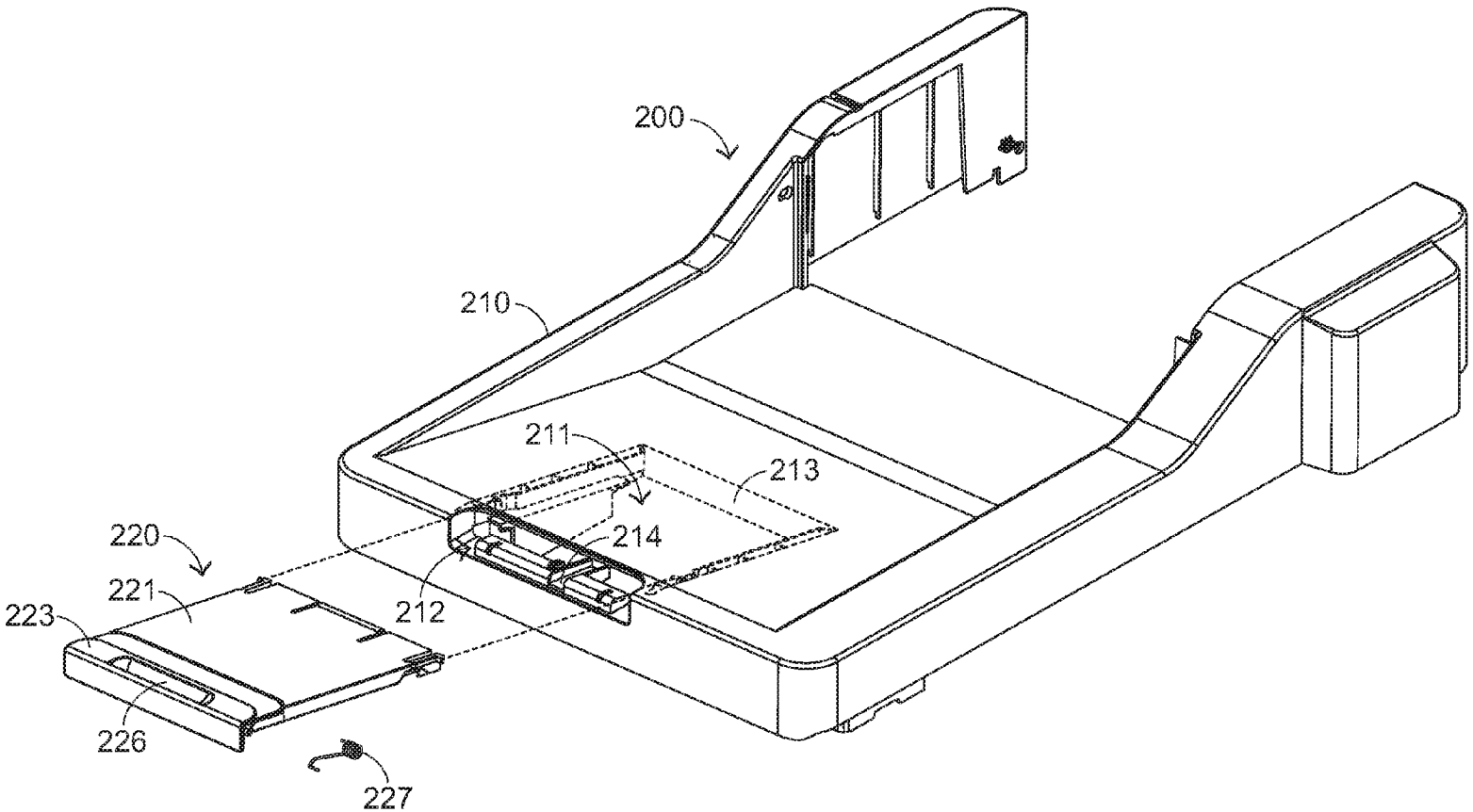
FIG. 2 is a schematic exploded view illustrating a paper tray according to an embodiment of the present invention.

FIG. 2 is a schematic exploded view illustrating a paper tray according to an embodiment of the present invention. The paper tray 200 of the present invention is fixed on an office machine (not shown). As shown in FIG. 2, the paper tray 200 comprises a first plate 210 and an extension mechanism 220. Moreover, the extension mechanism 220 is movable relative to the first plate 210.

The detailed configurations of the first plate 210 will be illustrated as follows. The first plate 210 comprises a receiving space 211 and a guiding groove 214. The guiding groove 214 is located within the receiving space 211 of the first plate 210. The receiving space 211 is located at an end of the first plate 210 for accommodating the extension mechanism 220. In this embodiment, the receiving space 211 has an opening 212 and an inner wall 213. The opening 212 is opposed to the inner wall 213.

In a case that the size of the paper to be supported exceeds a supporting range of the first plate 210, the extension mechanism 220 accommodated within the receiving space 211 may be expanded from the opening 212 of the receiving space 211 in order to expand the supporting range of the paper tray 200. Under this circumstance, the possibility of falling down the papers from the paper tray 200 will be reduced.

The detailed configurations of the extension mechanism 220 will be illustrated as follows. Please refer to FIG. 2 again. The extension mechanism 220 of the paper tray 200 comprises a second plate 221, a paper stopper 223, and an elastic element 227. The paper stopper 223 is pivotally coupled to the second plate 221 and rotatable relative to the second plate 221 for stopping the papers. Consequently, the possibility of falling down the papers from the paper tray 200 will be minimized or eliminated.

The elastic element 227 is disposed under the second plate 221, and disposed in the guiding groove 214 of the first plate 210 for driving movement of the second plate 221, so that the second plate 221 is moved relative to the first plate 210. In an embodiment, an example of the elastic element 227 includes but is not limited to a torsion spring.

Figure 3:
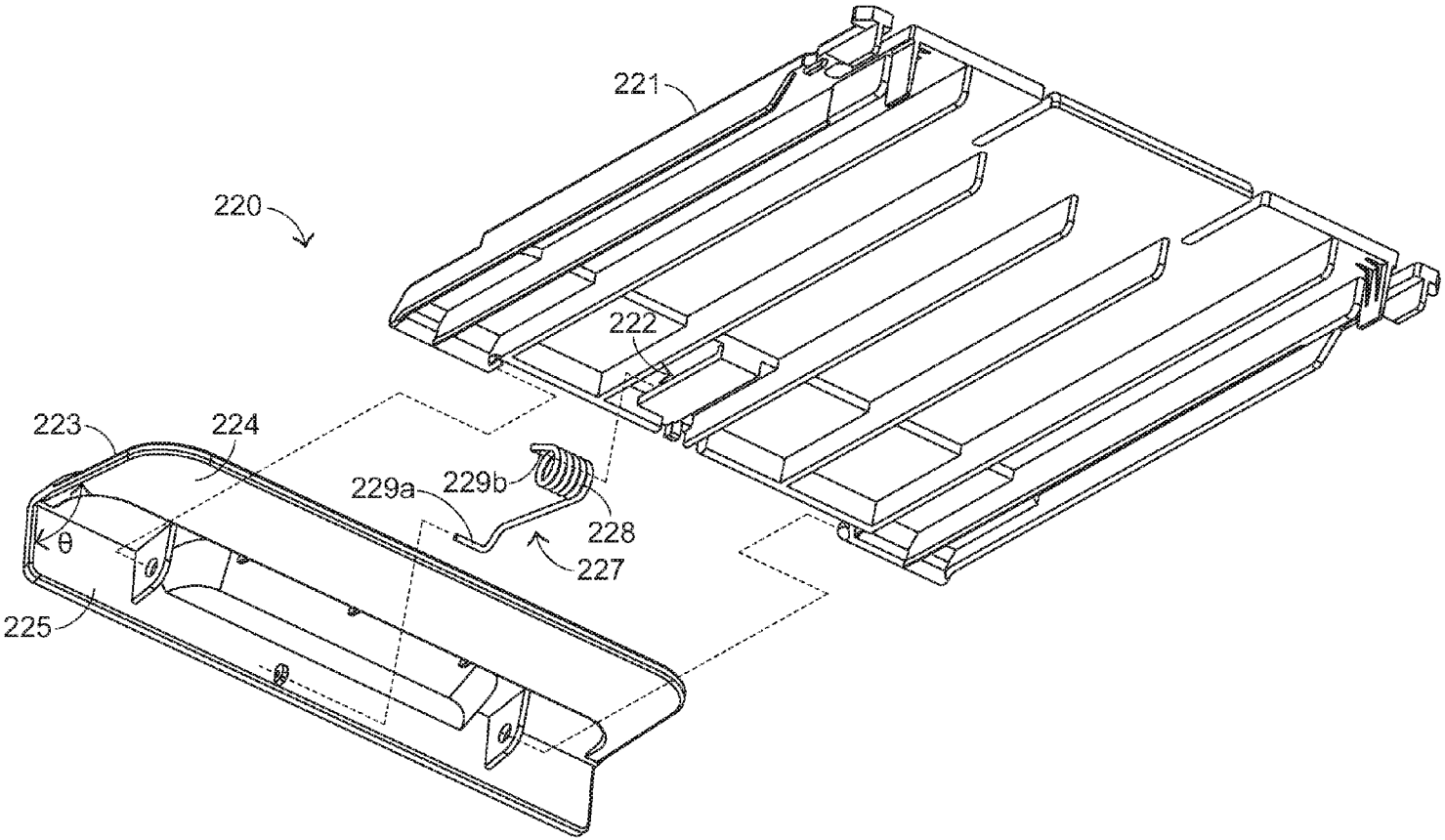
FIG. 3 is a schematic exploded view illustrating the extension mechanism of the paper tray of FIG. 2 and taken along an upward viewpoint.

FIG. 3 is a schematic exploded view illustrating the extension mechanism of the paper tray of FIG. 2 and taken along an upward viewpoint. As shown in FIG. 3, the second plate 221 of the extension mechanism 220 comprises a sliding groove 222. The sliding groove 222 is formed in a bottom surface of the second plate 221. In this embodiment, the sliding groove 222 is located beside a T-shaped bulge under the second plate 221. It is noted that the position of the sliding groove 222 is not restricted.

In some embodiments, the sliding groove 222 is located beside an L-shaped bulge under the second plate 221, an inverted U-shaped bulge or any other shaped bulge. Alternatively, the sliding groove 222 is directly formed on a ribbed plate under the second plate 221.

The paper stopper 223 of the second plate 221 comprises a stopping part 224 and a sustaining part 225. A side of the stopping part 224 is connected with a side of the sustaining part 225. The stopping part 224 is used for contacting and stopping the papers. The sustaining part 225 is used for driving and sustaining against the elastic element 227. In this embodiment, there is an included angle θ between the stopping part 224 and the sustaining part 225. The included angle θ is smaller than or equal to 90 degrees. It is noted that the included angle θ is not restricted.

Furthermore, in this embodiment, the stopping part 224 and the sustaining part 225 of the paper stopper 223 are integrally formed as a one-piece plastic element. It is noted that the stopping part 224 and the sustaining part 225 are not restricted to the one-piece plastic element. In some embodiments, the stopping part 224 and the sustaining part 225 of the paper stopper 223 are separate structures. Under this circumstance, each of the stopping part 224 and the sustaining part 225 may be made of a metallic material, a plastic material or any other suitable material. Moreover, the stopping part 224 and the sustaining part 225 may be combined together by a screwing means, a riveting means, an adhering means, a welding means, an engaging means or any other suitable means.

Please refer to FIG. 3 again. The elastic element 227 comprises a helical part 228, a first elastic arm **229*a*, and a second elastic arm 229*b*. The first elastic arm 229*a* and the second elastic arm 229*b* are located at two opposite sides of the helical part 228**, respectively.

The helical part 228 of the elastic element 227 is accommodated within the guiding groove 214 and contacted with a surface of the guiding groove 214. The first elastic arm **229*a* of the elastic element 227 is connected with the sustaining part 225 of the paper stopper 223. In this embodiment, the first elastic arm 229*a* is penetrated through a perforation of the sustaining part 225. Alternatively, in some embodiments, the first elastic arm 229*a* is not penetrated through a perforation of the sustaining part 225. The second elastic arm 229*b* of the elastic element 227 is accommodated within the sliding groove 222, and movable relative to the sliding groove 222**.

Figure 4:
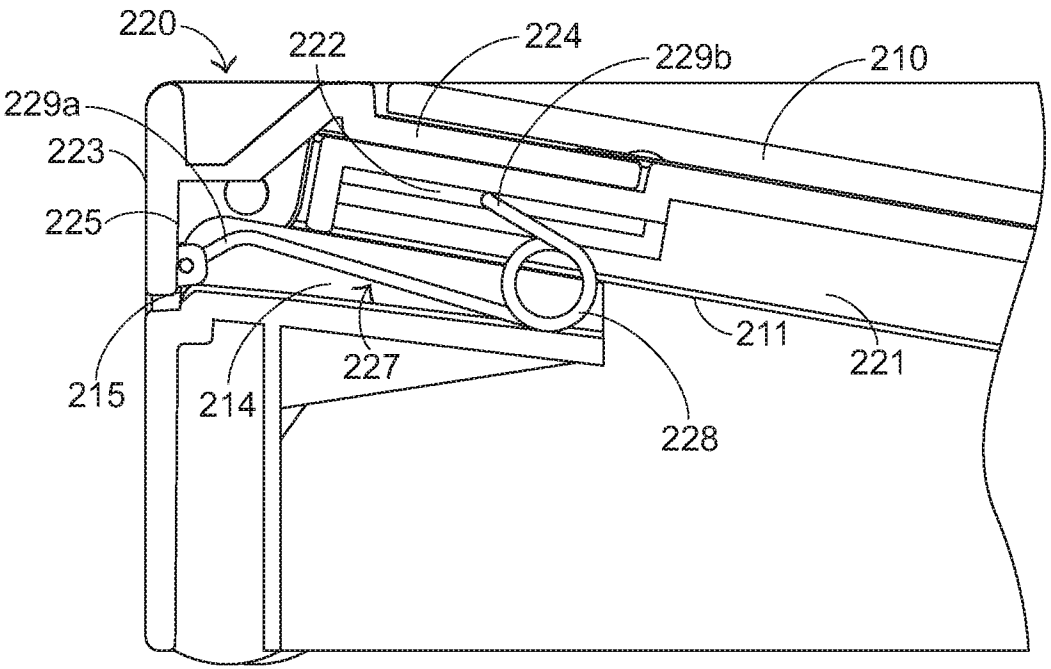
FIGS. 4, 5 and 6 schematically illustrate the operations of the paper tray of the present invention.
Figure 5:
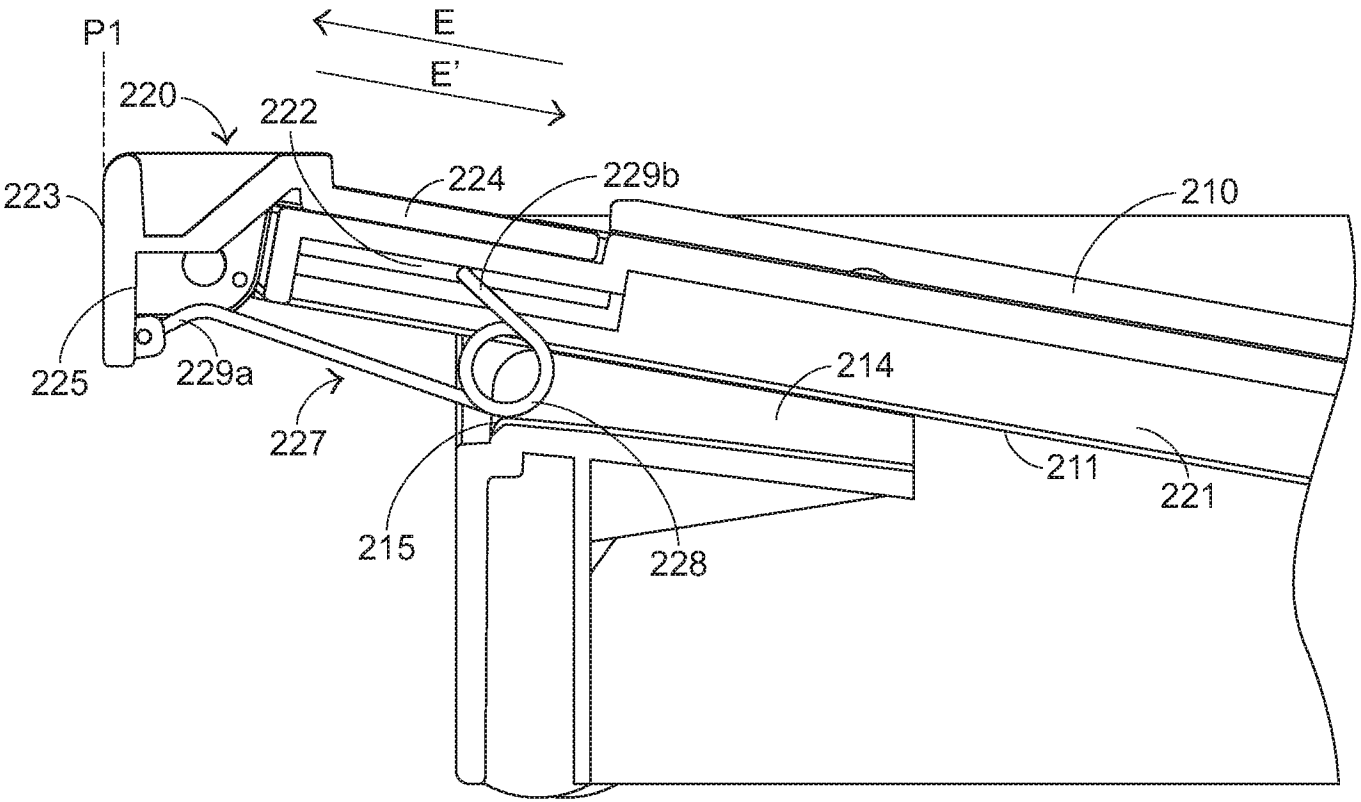
Figure 6:
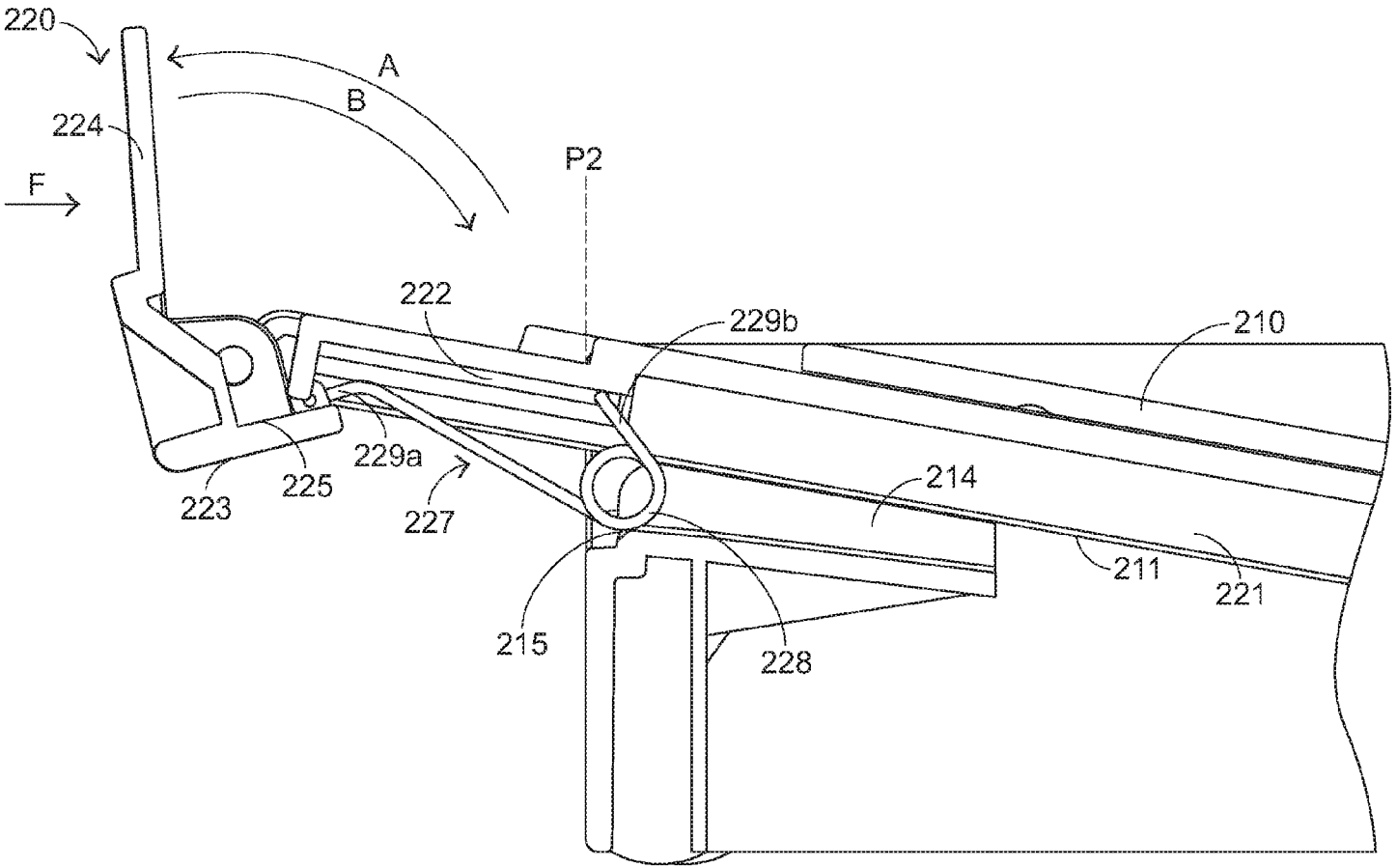

Please refer to FIGS. 4, 5 and 6. FIGS. 4, 5 and 6 schematically illustrate the operations of the paper tray of the present invention.

As shown in FIG. 4, the extension mechanism 220 is accommodated within the receiving space 211 of the first plate 210. Meanwhile, the paper stopper 223 is rotated relative to the second plate 221 to be stacked on the second plate 221. In addition, the second plate 221 and the elastic element 227 are both accommodated within the receiving space 211 of the first plate 210.

As shown in FIG. 5, the paper stopper 223 of the extension mechanism 220 is moved in an expanding direction E to be distant from the receiving space 211 of the first plate 210. As the paper stopper 223 is moved, the second plate 221 is correspondingly moved in a direction opposite to the first plate 210, and the elastic element 227 is correspondingly moved relative to the guiding groove 214. When the second plate 221 is moved to a first position P1, the helical part 228 of the elastic element 227 is correspondingly moved to a front end of the guiding groove 214 and contacted with a slant 215 at the front end of the guiding groove 214.

As shown in FIG. 6, when the paper stopper 223 is rotated relative to the second plate 221 in a first direction A, the sustaining part 225 at an end of the paper stopper 223 is rotated with the paper stopper 223 to push against the first elastic arm 229*a* of the elastic element 227. Consequently, the first elastic arm 229*a* of the elastic element 227 is moved to a position close to the first plate 210. Moreover, since the second plate 221 is linked to the elastic element 227, the distal end of the sliding groove 222 is sustained against the second elastic arm 229*b* of the elastic element 227.

In other words, by rotating the paper stopper 223 of the paper tray of the present invention, the relative positions between the first elastic arm 229*a* and the second elastic arm 229*b* are adjustable. Consequently, the elastic element 227 is subject to deformation to generate an elastic potential energy.

Please refer to FIG. 6 again. When the user wants to store the expanded extension mechanism 220, the user may push the paper stopper 223 in a force-exerting direction F. Consequently, the paper stopper 223 is rotated relative to the second plate 221 in a second direction B to be stacked on the second plate 221 again. Since the sustaining part 225 is rotated with the paper stopper 223, the elastic element 227 is no longer pushed by the sustaining part 225. Under this circumstance, the first elastic arm 229*a* is moved to a position far from the first plate 210, and the elastic potential energy contained in the elastic element 227 is released.

Please refer to FIGS. 5 and 6 again. When the elastic potential energy of the elastic element 227 is released, the elastic potential energy may drive the elastic element 227 to surmount the slant 215 at the front end of the guiding groove 214. Consequently, the elastic element 227 is moved in a direction facing the first plate 210. At the same time, the second plate 221 and the paper stopper 223 are moved to a second position P2 in a restoring direction E' (see FIG. 5). Under this circumstance, the second plate 221 and the elastic element 227 are accommodated within the receiving space 211 of the first plate 210 (see FIG. 4). In such way, the automatic position-restoring function of the paper tray 200 is achieved.

Moreover, in this embodiment, for smoothly moving the extension mechanism 220 into the receiving space 211 of the first plate 210, the opening 212 of the receiving space 211 is located at an altitude higher than the inner wall 213. When the extension mechanism 220 is moved toward the first plate 210, not only the elastic potential energy of the elastic element 227 but also the gravitational traction can increase the efficiency and the success rate of allowing the extension mechanism 220 to be restored to the home position. It is noted that the opening 212 of the receiving space 211 is not restricted to be located at an altitude higher than the inner wall 213.

Moreover, in some other embodiments, the extension mechanism 220 may be automatically restored to the home position without the need of using an additional device or structure. Alternatively, the extension mechanism 220 may be automatically restored to the home position by using any conventional non-contact force (e.g. a magnetic force).

Moreover, for facilitating the user to move the extension mechanism 220 to have the extension mechanism 220 smoothly depart from the receiving space 211 of the first plate 210, the extension mechanism 220 further comprises a concave structure 226 (see FIG. 2). In this embodiment, the concave structure 226 is located at a backside of the stopping part 224. It is noted that the concave structure 226 is not restricted to be at the backside of the stopping part 22. Alternatively, in some embodiments, the concave structure 226 is omitted. Whereas, the extension mechanism 220 may be equipped with a handle, a belt, a raised ring or any force-exerting structure or device for allowing the user to apply a force on the extension mechanism 220.

From the above description, the paper tray of the present invention comprises a first plate and an extension mechanism. The first plate comprises a receiving space and a guiding groove. The extension mechanism comprises a second plate, a paper stopper, and an elastic element. The extension mechanism is accommodated within the receiving space and movable relative to the first plate. When the extension mechanism is moved in a direction opposite to the first plate and the paper stopper is rotated relative to the second plate in a first direction, the elastic element is subject to deformation to generate an elastic potential energy. When the paper stopper is rotated relative to the second plate in a second direction, the elastic potential energy of the elastic element is released. The elastic potential energy may drive the extension mechanism to be automatically restored to the receiving space of the first plate. Since the paper tray of the present invention is designed to have the automatic position-restoring function, the problems resulted from manual storage of the conventional paper tray will be eliminated. Under this circumstance, the efficiency of storing the paper tray is enhanced. Moreover, as previously described, if the storing process is incorrect, the conventional paper tray fails to be successfully stored. In comparison with the conventional paper tray, the success rate of storing the paper tray of the present invention is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper tray for supporting a paper, said paper tray comprising:

a first plate comprising a receiving space and a guiding groove, wherein said guiding groove is located within said receiving space; and an extension mechanism accommodated within said receiving space, and comprising:

a second plate comprising a sliding groove, wherein said sliding groove is formed in a bottom surface of said second plate;

a paper stopper pivotally coupled to said second plate and rotatable relative to said second plate; and an elastic element disposed in said guiding groove of said first plate, and comprising a helical part, a first elastic arm, and a second elastic arm, wherein said helical part is contacted with a surface of said guiding groove and movable relative to said guiding groove, said first elastic arm is connected with said paper stopper, and said second elastic arm is accommodated within said sliding groove of said second plate, wherein when said second plate is moved to a first position in a direction opposite to said first plate and said paper stopper is rotated in a first direction, said elastic element is pushed by an end of said paper stopper, so that said elastic element generates an elastic potential energy, wherein when said paper stopper is rotated in a second direction, said elastic potential energy drives movement of said elastic element in a direction facing said first plate, so that said second plate is moved to a second position and accommodated within said receiving space.

2. The paper tray according to claim 1, wherein said paper stopper comprises a stopping part for stopping said paper and a sustaining part for sustaining against said elastic element, wherein said stopping part is connected with said sustaining part, and an included angle is formed between said stopping part and said sustaining part, wherein said included angle is smaller than or equal to 90 degrees.

3. The paper tray according to claim 1, wherein said paper stopper further comprises a concave structure for facilitating moving said extension mechanism.

4. The paper tray according to claim 1, wherein said guiding groove has a slant, and said slant is located at a front end of said guiding groove, wherein when said second plate is moved to said first position and said paper stopper is rotated in said first direction, said helical part of said elastic element is contacted with said slant.

5. The paper tray according to claim 1, wherein said receiving space has an opening and an inner wall, wherein said opening is opposed to said inner wall, and said opening is located at an altitude higher than said inner wall.

6. The paper tray according to claim 1, wherein said elastic element is a torsion spring.

* * * * *